United States Patent [19]

Higuchi

[11] 4,234,770

[45] Nov. 18, 1980

[54] SECTIONALIZED PORCELAIN INSULATOR HAVING REMOVABLE CIRCUIT BREAKER

[75] Inventor: Kōsuke Higuchi, Yokohama, Japan

[73] Assignee: Tokyo Shibaura Denki Kabushiki Kaisha, Tanagawa, Japan

[21] Appl. No.: 914,774

[22] Filed: Jun. 12, 1978

[30] Foreign Application Priority Data

Jun. 21, 1977 [JP] Japan ..... 52-72803

[51] Int. Cl.[3] ..... H01H 9/08; B65D 6/00; H01B 17/04; H01H 33/66

[52] U.S. Cl. ..... 200/144 B; 174/150; 200/293; 220/4 D

[58] Field of Search ..... 200/144 B, 145, 146 R, 200/148 A, 148 B, 148 D, 148 F, 293, 303, 147 R (U.S. only), 148 R (U.S. only); 220/4 D; 361/335, 340, 341, 343; 174/141 R, 150, 161 R

[56] References Cited

U.S. PATENT DOCUMENTS

| | | | |
|---|---|---|---|
| 1,385,484 | 7/1921 | Case | 220/4 D |
| 2,542,798 | 2/1951 | Cumming | 174/150 X |
| 3,124,669 | 3/1964 | Perolini | 200/145 X |
| 4,037,187 | 7/1977 | Himi | 174/150 X |

*Primary Examiner*—James R. Scott

*Attorney, Agent, or Firm*—Stevens, Davis, Miller & Mosher

[57] ABSTRACT

A porcelain insulator type circuit breaker comprises a lower porcelain tube secured to a supporting frame, an upper porcelain tube mounted on the lower porcelain tube, an interrupting unit accommodated in the upper porcelain tube, and a rotating device for connecting the lower porcelain tube and the upper porcelain tube in a rotatable manner.

2 Claims, 4 Drawing Figures

SECTIONALIZED PORCELAIN INSULATOR HAVING REMOVABLE CIRCUIT BREAKER

BACKGROUND OF THE INVENTION

This invention relates to porcelain insulator type circuit breaker having an insulating tube provided with an interrupting unit and capable of easily removing the unit from the tube, particularly for the inspection of the circuit breaker.

FIG. 1 shows a conventional typical 60 KV-class three-phase porcelain insulator type circuit breaker, in which, in each phase, an interrupting unit is accomodated in an upper porcelain tube 4 mounted on a lower porcelain tube 2 which is secured to a supporting frame 1. In such a prior art circuit breaker, when it is required to remove the interrupting unit 3 from the upper porcelain tube for the inspection thereof, the unit 3 is taken out by firstly opening a head cover 30, removing bolts for securing the unit 3 and lifting the unit from the upper porcelain tube 4 by means of a crane 31 or the like or by lifting and shifting the upper tube 4 to another place and taking out the interrupting unit 3 from the tube 4 at that place.

However, such methods for removing the interrupting unit involve the following problems.

1. A considerably large space is required above the circuit breaker for lifting and removing the interrupting unit therefrom, and particularly, in an indoor installation type, it is necessary to build a considerably tall building.
2. Lifting means such as a crane is needed for lifting the interrupting unit or the upper porcelain tube.
3. A scaffold is required to assist the disassembly of the circuit breaker for the reason that the circuit breaker is mounted on the supporting frame and the upper porcelain tube or the interrupting unit is further lifted upwardly. Furthermore, much caution must be exercised for workers who work at a high position (usually, more than 2 m above the ground surface).

In another example of the prior art, a frame is attached to the lower porcelain tube 2 and on the frame there is provided rails and a carriage movable therealong. In this prior art example, the interrupting unit 3 is removed from the upper porcelain tube 4 in a manner that the upper porcelain tube 4 is shifted on the carriage and moved on the rails and the interrupting unit 3 is then taken out from the lower end of the upper tube 4. However, in such a case, the use of the rails and the carriage and the assembling of these members involves much time and more work and thus is not advantageous.

SUMMARY OF THE INVENTION

Accordingly, it is an object of this invention to remove the defects of the prior arts described above and to provide an improved porcelain insulator type circuit breaker permitting easy removal of the interrupting unit of the circuit breaker without using any specific means such as a crane, rails or a carriage.

According to this invention, there is provided a porcelain insulator type circuit breaker including a lower porcelain tube secured to a supporting frame, an upper porcelain tube mounted on the lower porcelain tube, and an interrupting unit provided in the upper porcelain tube, wherein the upper porcelain tube is connected to the lower porcelain tube by a rotatable device so that the interrupting unit is taken out from the lower end of the rotated upper porcelain tube.

DESCRIPTION OF THE PREFERRED EMBODIMENT

Figure 1:
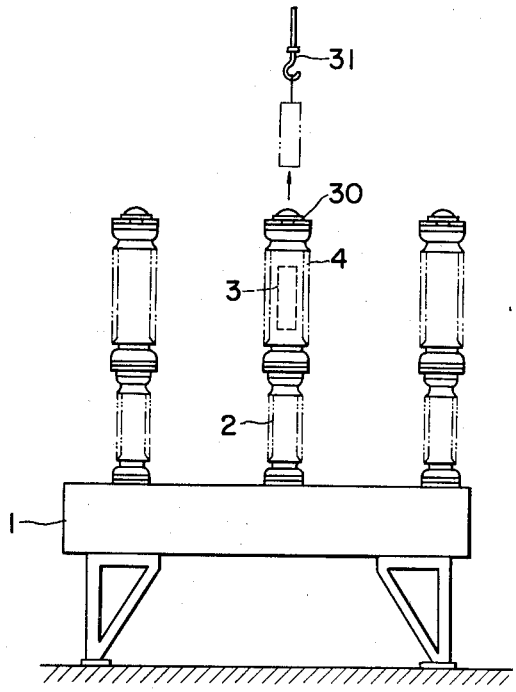
FIG. 1 PRIOR ART
FIG. 1 shows one example of a prior art method of taking out an interrupting unit from an insulator type circuit breaker.
Figure 2:
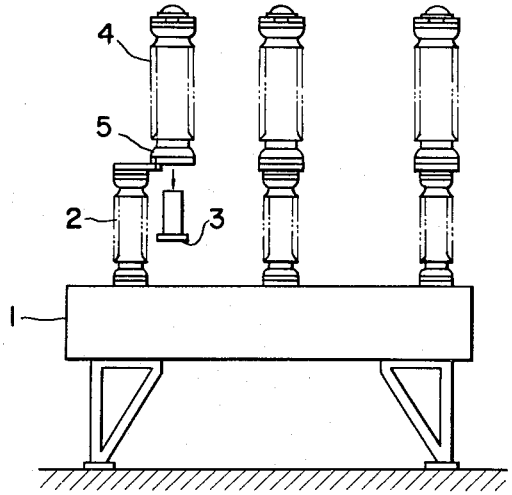
FIG. 2 is a general view showing a method of removing the interrupting unit from the porcelain insulator type circuit breaker according to this invention.

FIG. 2 shows a three-phase insulator type circuit breaker and illustrates the manner of removing the interrupting unit 3 from the lower end of upper porcelain tube 4 of the left phase of the circuit breaker by rotating the upper tube 4 about hinge means 5 fitted to the upper and lower porcelain tubes 4 and 2 and by removing bolts securing the interrupting unit 3.

The removal of the interrupting unit 3 is described in detail hereinbelow with reference to FIGS. 3 and 4.

Figure 3:
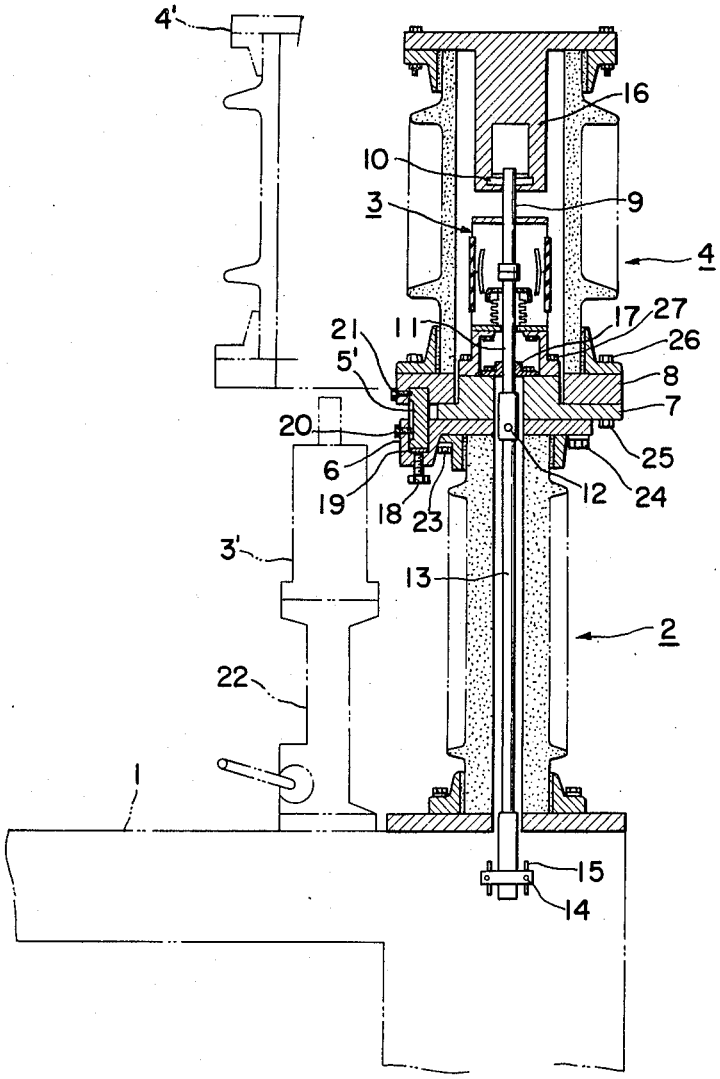
FIG. 3 is a partial cross-sectional view of the porcelain insulator type circuit breaker of this invention and shows how to take out the interrupting unit.
Figure 4:
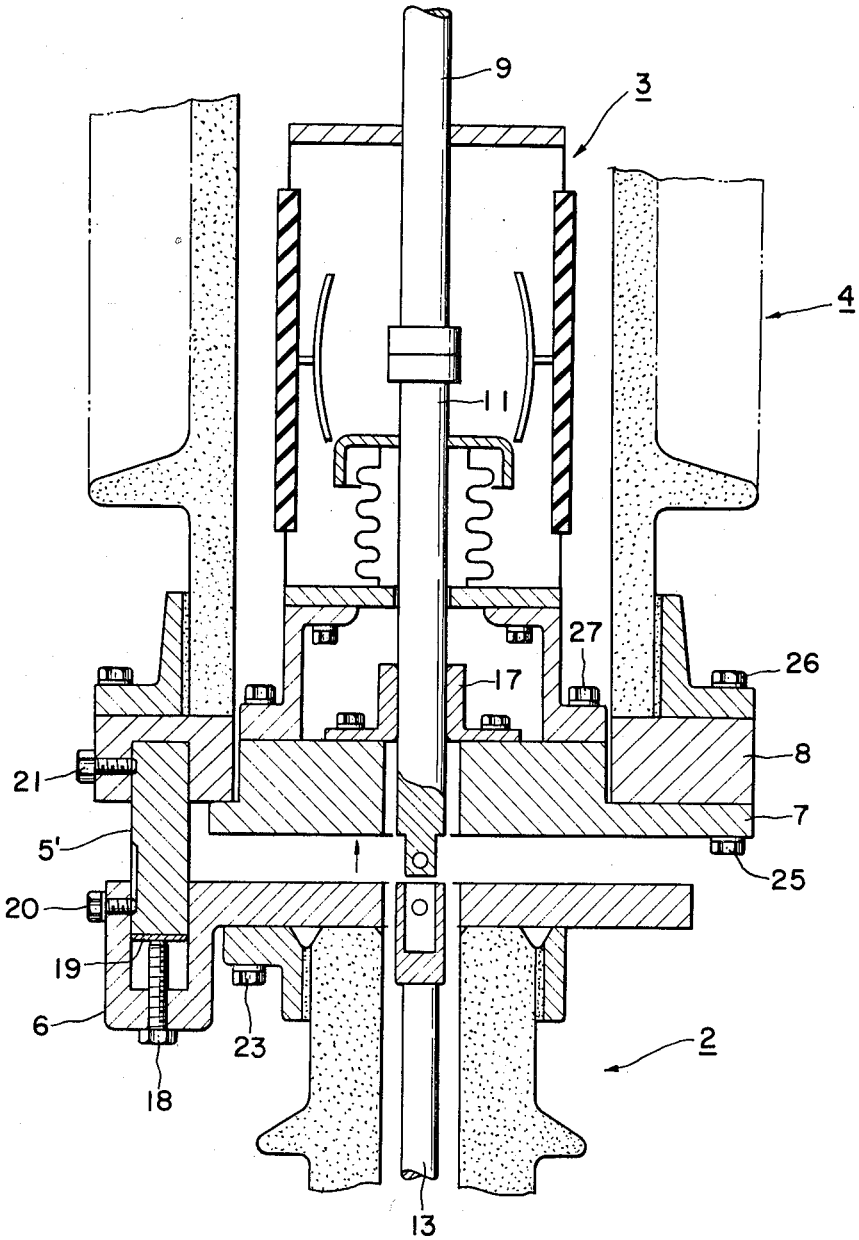
FIG. 4 is a cross-sectional view in an enlarged scale of the important parts of the circuit breaker of this invention in which the upper porcelain tube has been jacked up.

FIG. 3 shows a cross-section of one phase of the circuit breaker and dot and dash lines represent the position of the upper porcelain tube 4 after it has been rotated about the hinge means 5 and the interrupting unit 3 has been removed. With a three-phase circuit breaker, three lower supporting porcelain tube 2 are mounted on the supporting frame 1, and a supporting plate 6, a guide member 7 and an intermediate flange 8 are interposed in the order mentioned between each lower tube 2 and each upper tube 4 for supporting the hinge means 5. In this structure, a blot 23 secures the supporting plate 6 to the lower porcelain tube 2 and a bolt 24 clamps the plate 6 and the guide member 7, which is secured to the intermediate flange 8 by a blot 25. Bolts 26 secure the flange 8 to the upper tube 4.

The interrupting unit 3, for example comprising vacuum switch in this embodiment, accommodated in the upper porcelain tube 4 is secured at its lower end to the guide member 7 by bolts 27, and stationary electrode 9 extends into the unit 3 through the upper end plate thereof, the electrode 9 contacting a slide contact 10 fitted to a contact pedestal 16. A movable electrode 11 of the interrupting unit 3 is connected to an operating rod 13 through a coupling pin 12 disposed at the central portion of the supporting plate 6, and the operating rod 13 is connected to a driving lever 15 through pins 14 at the lower side of the supporting porcelain tube 2. Current passes from the electrode 11 to an external terminal, not shown, through a sliding contact 17 mounted on the guide member 7 and the guide member.

When it is desired to take out the interrupting unit 3 from the upper porcelain tube 4, the tube 4 is rotated about the hinge means 5 to the position 4' shown by dot and dash lines shown in FIG. 3. The hinge means 5 comprises a jack bolt 18 for upwardly forcing the interrupting unit 3, a thrust washer 19, a hinge 5', a lateral guide pin 20 engaging the recess of the hinge for preventing the slip-out of the hinge, and a lateral pin 21 for securing the hinge 5' to the intermediate flange 8. In the case where it is difficult to manually hold and take out the interrupting unit 3 from the upper porcelain tube 4, a lifting gear 22 shown by dot and dash lines in FIG. 3 may be used by mounting it on the supporting frame 1 for putting the unit 3 on the lifting gear and taking it out.

The operation for removing the interrupting unit 3 from the circuit breaker will now be described hereunder.

The pin 14 is first removed to disconnect it from an operating mechanism, not shown, and the bolt 24 clamping the supporting plate 6 and the guide member 7 is then removed. The jack bolt 18 is rotated by known means so as to lift the structure including the guide member 7 and the upper porcelain tube 4 provided with the interrupting unit 3, and the rotation of the jack bolt 18 is stopped when the structure is lifted to a position where the pin 12 connecting the operating rod 13 and the movable electrode 11 can be removed. This state is illustrated in FIG. 4. After removing the pin 12, the upper porcelain tube 4 can be rotated manually by about 180° and the position 4' of the rotated tube 4 is shown by dot and dash lines in FIG. 3. Then the guide member 7 and the interrupting unit 3 mounted thereon can be taken out from the lower end of the tube 4 by removing the bolt 25, and if the unit 3 is too heavy to hold and lower it by hand, a device such as an lifting gear 22 in FIG. 3 may be used.

It should be noted that this invention is not limited to the embodiment described above in conjunction with FIGS. 3 and 4. For example in a modification the hinge means is not previously assembled into the circuit breaker but constructed as an independent device. The device is used by securing it to the lower supporting porcelain tube and the flange of the upper tube with bolts when it is desired to remove the interrupting unit, for example, for the purpose of inspection and repair. In such a case, it is possible to provide only one hinge device for a substation, which is economical.

The advantages of the improved porcelain insulator type circuit breaker according to this invention will be summarized as follows.

Since there is no need for using a lifting device such as a crane at the time of the removal of the interrupting unit, an extra space above the circuit breaker is not required, and particularly, with an indoor type installation, it is not necessary to build a tall building. Furthermore, in this invention, the removal of the interrupting unit can be performed by using specific hinge means so that the upper porcelain tube is rotatable about the hinge means and the unit is taken out from the lower end of the upper tube. Therefore, regarding a 60 KV-class circuit breaker, for example, since the removal work can be carried out at a position lower than about 2 m, it is not necessary to assemble a specific scaffold as used in the prior art circuit breaker whereby a safe operation and safety of the workers can be assured.

What is claimed is:

1. In a porcelain insulator type circuit breaker including a lower porcelain tube secured to a supporting frame, an upper porcelain tube mounted on said lower porcelain tube in axial alignment therewith, and an interrupting unit provided in said upper porcelain tube, the improvement which comprises means for interconnecting said upper porcelain tube and said lower porcelain tube in a manner permitting rotation of said upper porcelain tube relative to said lower porcelain tube to displace said upper porcelain tube from axial alignment with said lower porcelain tube, said means comprising a jack bolt for upwardly forcing said upper porcelain tube from said lower porcelain tube and a hinge for interconnecting said upper and lower porcelain tubes so that said jacked-up upper porcelain tube can be rotated about said hinge so as to permit removal of said interrupting unit from the lower end of the rotated upper tube.

2. The circuit breaker according to claim 1 wherein said interrupting unit is a vacuum circuit breaker.

* * * * *